US011629032B2

(12) United States Patent
Solomon et al.

(10) Patent No.: US 11,629,032 B2
(45) Date of Patent: Apr. 18, 2023

(54) GRAB-TYPE LIFTER WITH VACUUM-ASSISTED LIFT PADS

(71) Applicants: Vacuworx Global, LLC, Tulsa, OK (US); Bakker Special Grabs, B.V., Huissen (NL)

(72) Inventors: William J. Solomon, Tulsa, OK (US); Justin Hendricks, Tulsa, OK (US); Federico Gusella, Huissen (NL); Rob Slikker, Huissen (NL)

(73) Assignees: Vacuworx Global, LLC, Tulsa, OK (US); Bakker Special Grabs B.V., Huissen (NL)

( * ) Notice: Subject to any disclaimer, the term of this patent is extended or adjusted under 35 U.S.C. 154(b) by 0 days.

(21) Appl. No.: 17/671,242

(22) Filed: Feb. 14, 2022

(65) Prior Publication Data

US 2022/0242700 A1 Aug. 4, 2022

Related U.S. Application Data

(63) Continuation of application No. 16/955,515, filed as application No. PCT/US2019/049754 on Sep. 5, 2019, now Pat. No. 11,247,873.

(60) Provisional application No. 62/727,249, filed on Sep. 5, 2018.

(51) Int. Cl.
*B66C 1/02* (2006.01)
*B66C 1/44* (2006.01)

(52) U.S. Cl.
CPC ..... *B66C 1/0256* (2013.01); *B66C 1/0243* (2013.01); *B66C 1/447* (2013.01)

(58) Field of Classification Search
CPC ... B66C 1/0237; B66C 1/0243; B66C 1/0256; B66C 1/0281; B66C 1/0287; B66C 1/447; B65G 47/915; B65G 47/918
USPC ..... 294/65
See application file for complete search history.

(56) References Cited

U.S. PATENT DOCUMENTS

| | | | | |
|---|---|---|---|---|
| 1,519,243 | A | 12/1924 | Ericsson | |
| 2,131,869 | A | 10/1938 | Burrell | |
| 3,771,825 | A * | 11/1973 | Yamada | B65G 47/90 294/198 |
| 4,228,993 | A | 10/1980 | Cathers | |
| 8,496,425 | B2 * | 7/2013 | Lin | B25J 15/0052 414/737 |
| 8,684,418 | B2 | 4/2014 | Lin et al. | |
| 10,011,022 | B1 | 7/2018 | Lin et al. | |

(Continued)

*Primary Examiner* — Dean J Kramer
(74) *Attorney, Agent, or Firm* — GableGotwals

(57) ABSTRACT

A material lifter comprising a vacuum pump, a frame containing the vacuum pump, an arm located on each of two opposing sides of the frame, each arm including an upper end pivotally connected to the frame, a cylinder located on each of the two opposing sides of the frame including an end connected to the frame and an end connected to a respective arm, a vacuum pad located on each of the two opposing sides of the frame and removably connected to a respective arm, the vacuum pads being moveable along the arm to a first location and a first orientation and a second different location and a second different orientation, wherein as the cylinders extend and retract the arms pivot toward and away from one another between a first position and a second different position and the vacuum pads remain in a same orientation during the pivot.

19 Claims, 12 Drawing Sheets

(56) References Cited

U.S. PATENT DOCUMENTS

| | | | |
|---|---|---|---|
| 10,144,619 | B2 † | 12/2018 | LaValley |
| 10,183,771 | B2 | 1/2019 | Wintergerst |
| 2014/0054911 | A1 | 2/2014 | Solomon |

* cited by examiner
† cited by third party

GRAB-TYPE LIFTER WITH VACUUM-ASSISTED LIFT PADS

CROSS-REFERENCE TO APPLICATIONS

This application claims priority to U.S. application Ser. No. 16/955,515 filed Jun. 18, 2020 which is a National Phase of PCT Application No. PCT/US2019/49754 filed Sep. 5, 2019 which claims priority to, and the benefit of, U.S. Provisional Application No. 62/727,249 filed Sep. 5, 2018, the content of which is incorporated by reference herein.

BACKGROUND

This disclosure is in the field of material handling equipment and, more particularly, to grab-type lifters configured to lift and transport heavy objects.

Grab-type material lifters are typically attached to the end of a boom an excavator, backhoe or other piece of large construction equipment. The lifter works by applying mechanical force between side arms and the object to be lifted. Typically, the side arms pivot between an open (load) and a closed (lift) position relative to the frame.

Vacuum material lifters also are typically attached to the end of a boom. The lifter works by pulling a vacuum between a pad containing a seal and the object to be lifted. The vacuum seal holds, even in the event of a power failure, until an operator activates a release. Typically, the pad is in a fixed position relative to the frame.

SUMMARY

Embodiments of a grab-type material lifter of this disclosure include a frame; at least one pair of opposing side arms or legs each pivotally connected at an upper end to the frame; and a vacuum pad connected to each side arm. The side arms pivot between an open (load) and a closed (lift) position relative to the frame. In some embodiments, the lifter includes two vacuum pads, one on each side arm. In other embodiments, the lifter includes opposing pairs of vacuum pads. The pads may be located on a spreader bar connected to the arm. The spreader bar may be square-shaped, rectangular-shaped, or round. The pads may be removable and interchanged with different pads, or the pads may be moved to a different location and orientation along the arm or spreader bar.

The frame may include vacuum pump in fluid communication with the vacuum pads. The vacuum pump may be a hydraulically-driven vacuum pump. The frame may include an onboard drive engine configured to power an actuator connected to each arm as well as the vacuum pump. The actuator may be a hydraulic cylinder. The drive engine may be an hydraulic drive engine. The lifter may include a coupler located at an upper end of the frame and configured for connection to a boom. In some embodiments, the coupler may include a pin-type connector and be configured for rotation about its central vertical axis. The coupler may include means for connecting to a hydraulic supply provided by a piece of equipment to which the lifter is attached.

DETAILED DESCRIPTION

Figure 2:
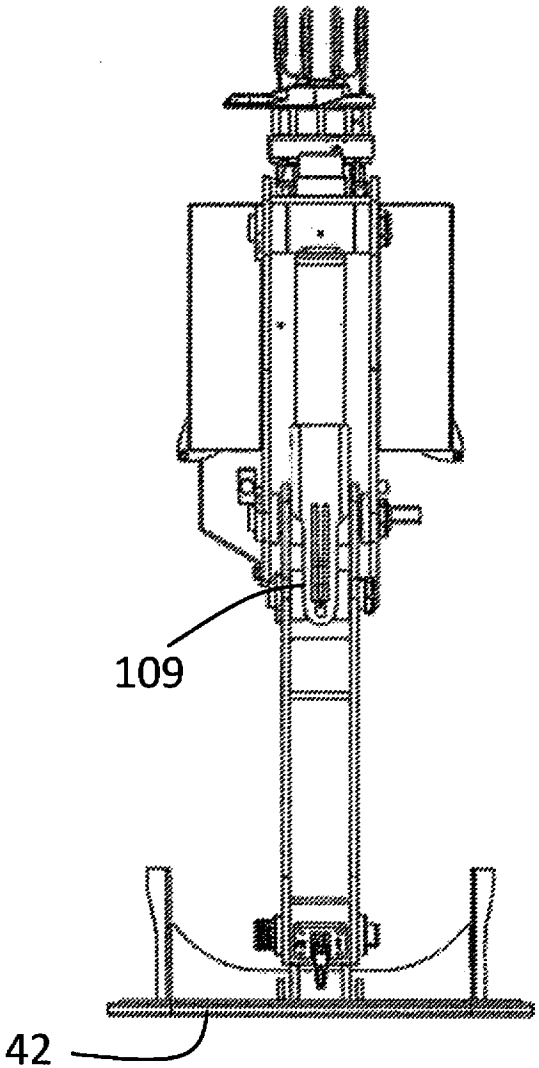
FIG. 2 is a side elevation view of the lifter of FIG. 1.
Figure 1:
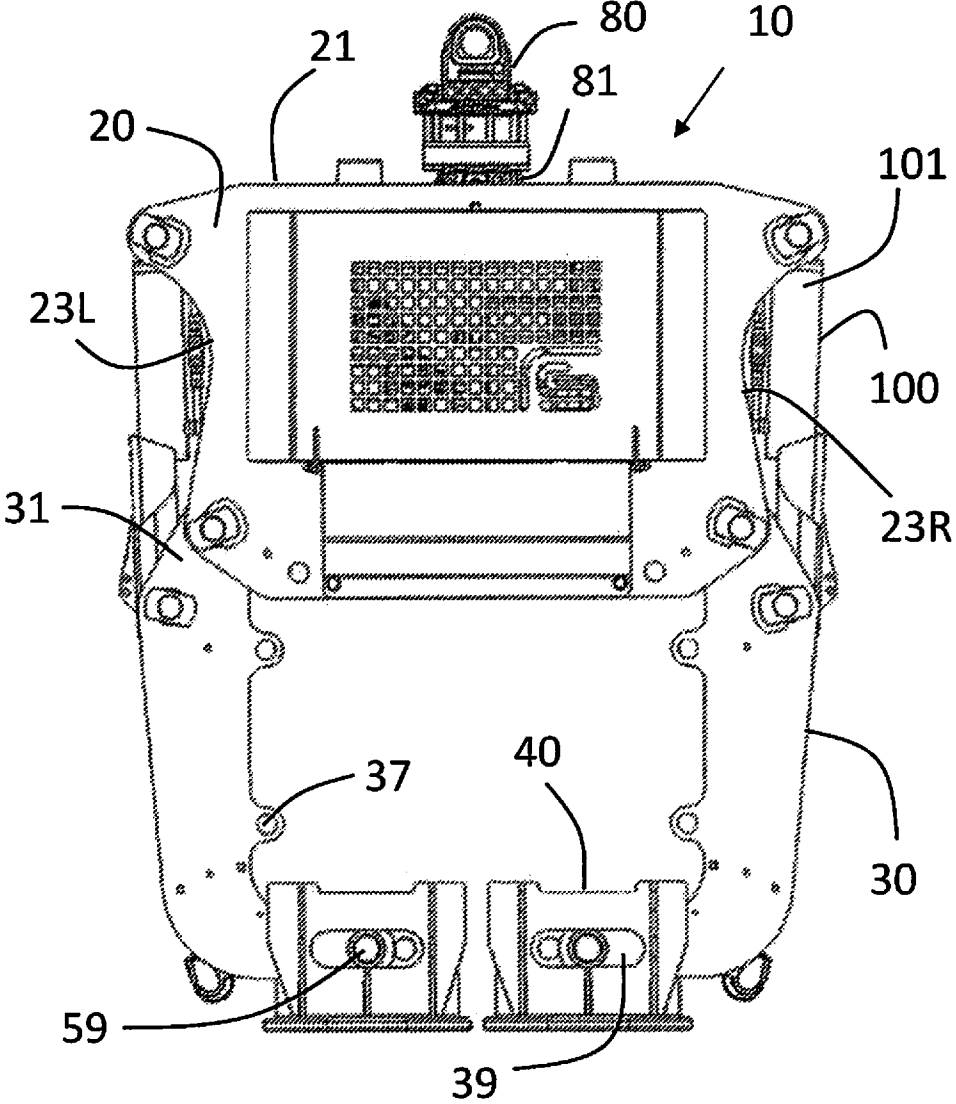
FIG. 1 is a front elevation view of an embodiment of a grab-type material lifter of this disclosure with the side arms in a vertical orientation and the vacuum lifter pads oriented in a horizontal orientation.
Figure 4A:
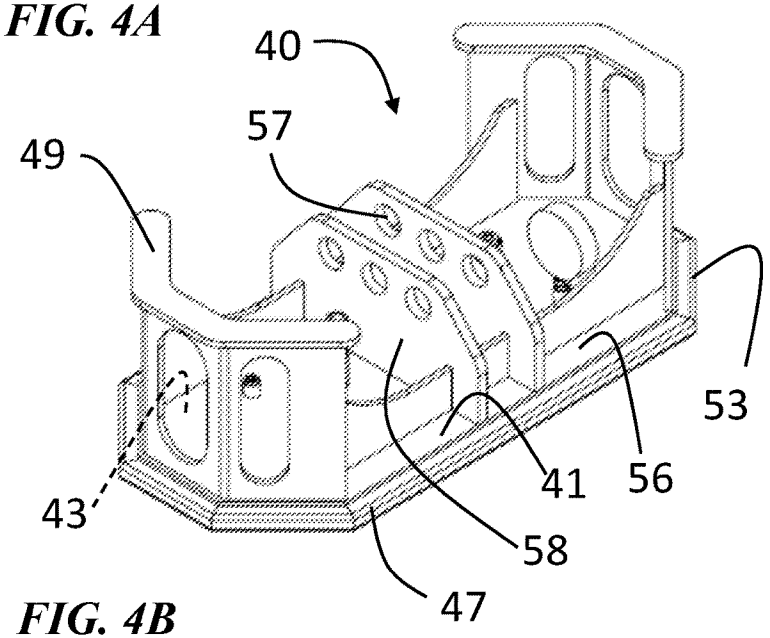
FIG. 4A is an isometric view of an embodiment of a vacuum pad of this disclosure.
Figure 4B:
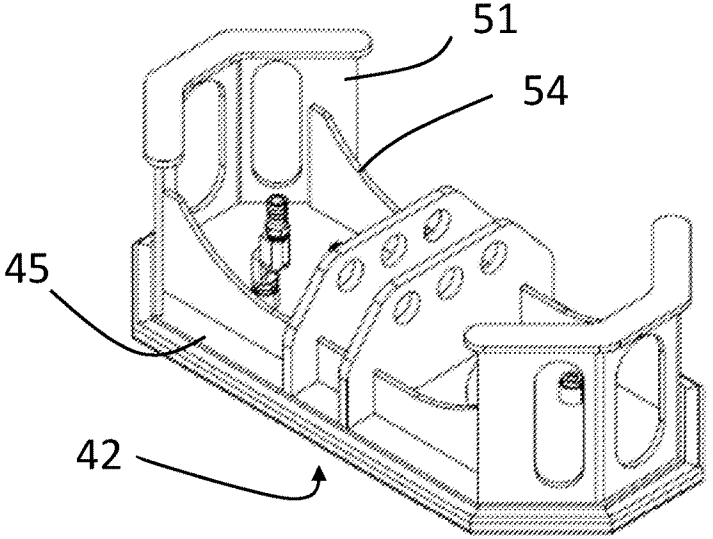
FIG. 4B is another isometric view of the vacuum pad of FIG. 4A.
Figure 3:
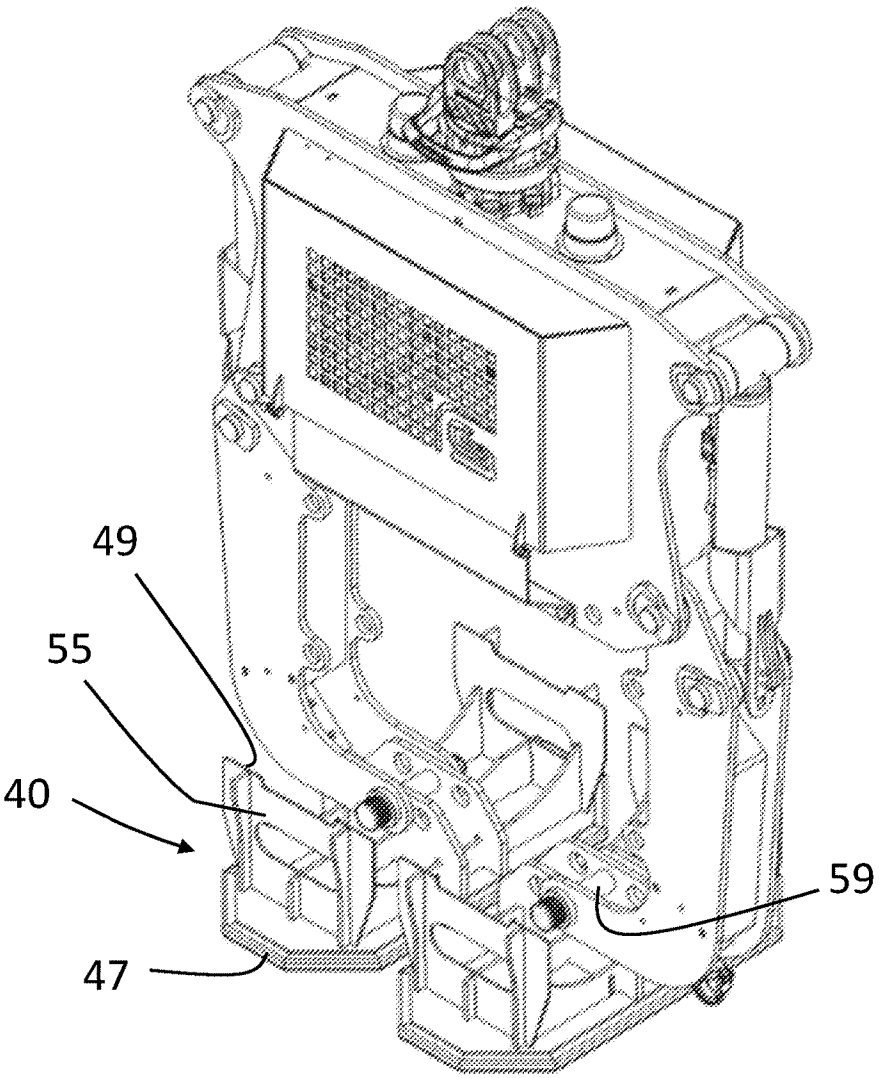
FIG. 3 is an isometric view of the lifter of FIG. 1.
Figure 4:
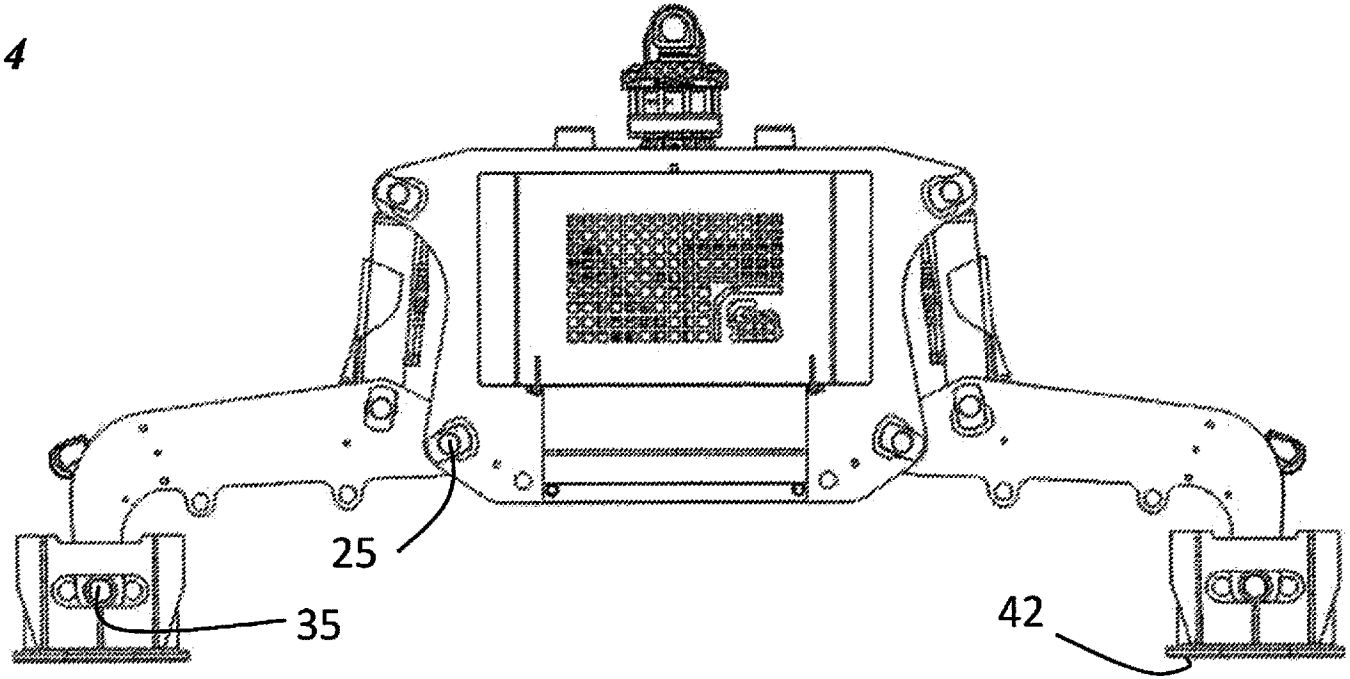
FIG. 4 is a front elevation view of an embodiment of material lifter of this disclosure with the side arms in a horizontal orientation and the vacuum lifter pads also oriented in a horizontal orientation. The pads may be rotated to a vertical orientation.
Figure 5:
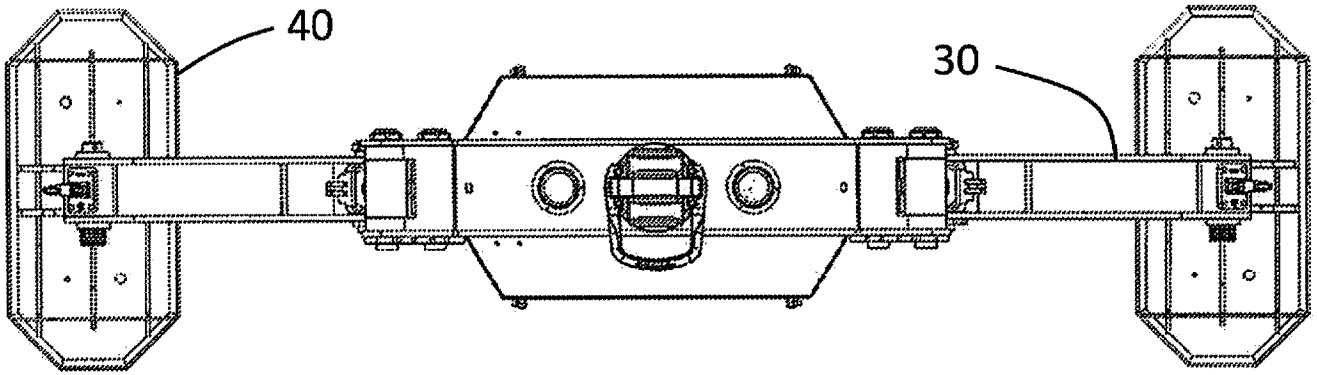
FIG. 5 is a top plan view of the lifter of FIG. 4.
Figure 6:
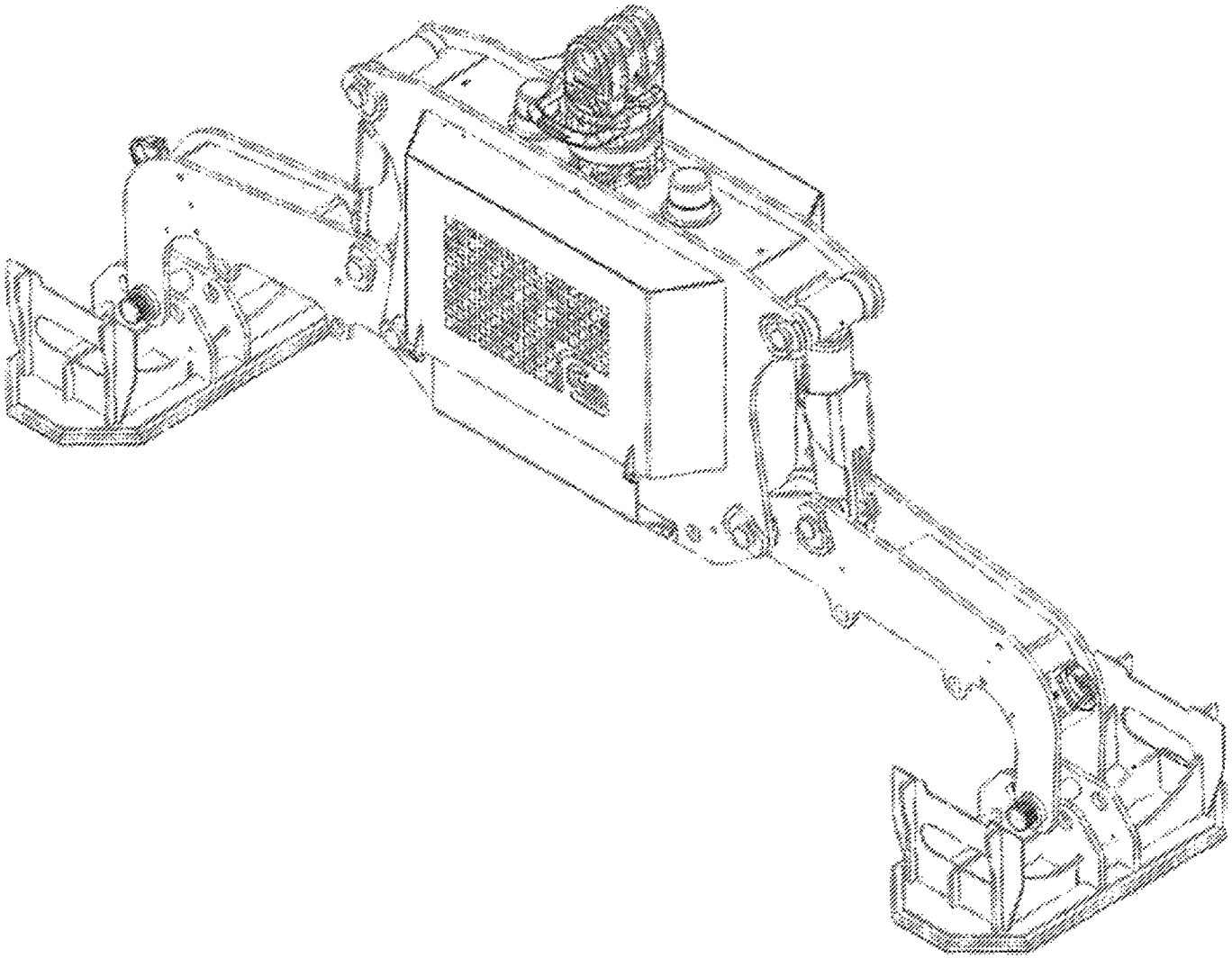
FIG. 6 is an isometric view of the lifter of FIG. 4 in a fully open position.
Figure 8:
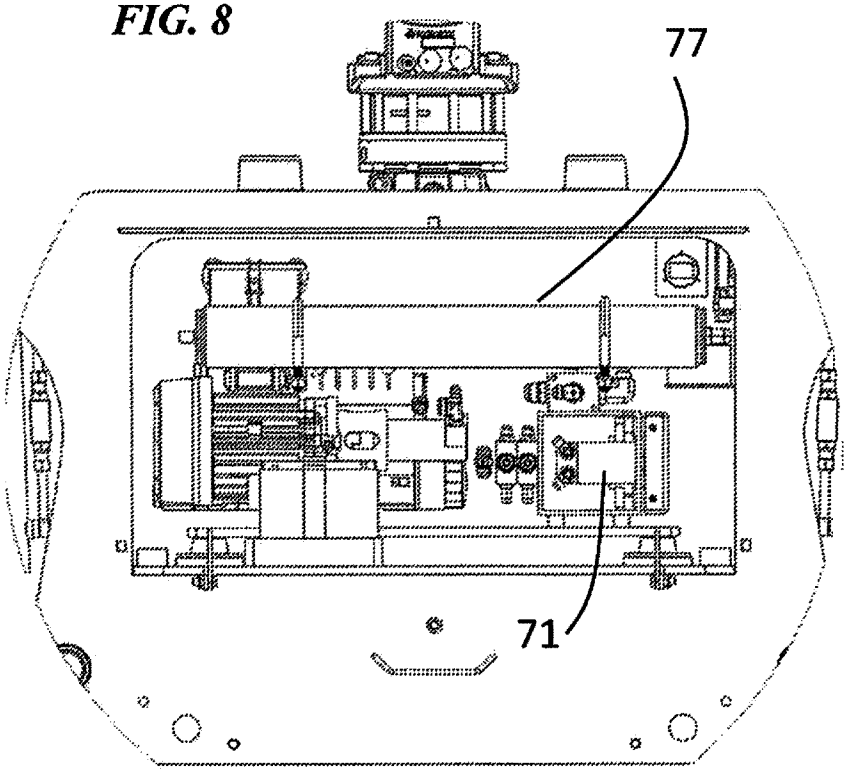
FIG. 8 is an enlarged rear elevation view of the frame of FIG. 7.
Figure 7:
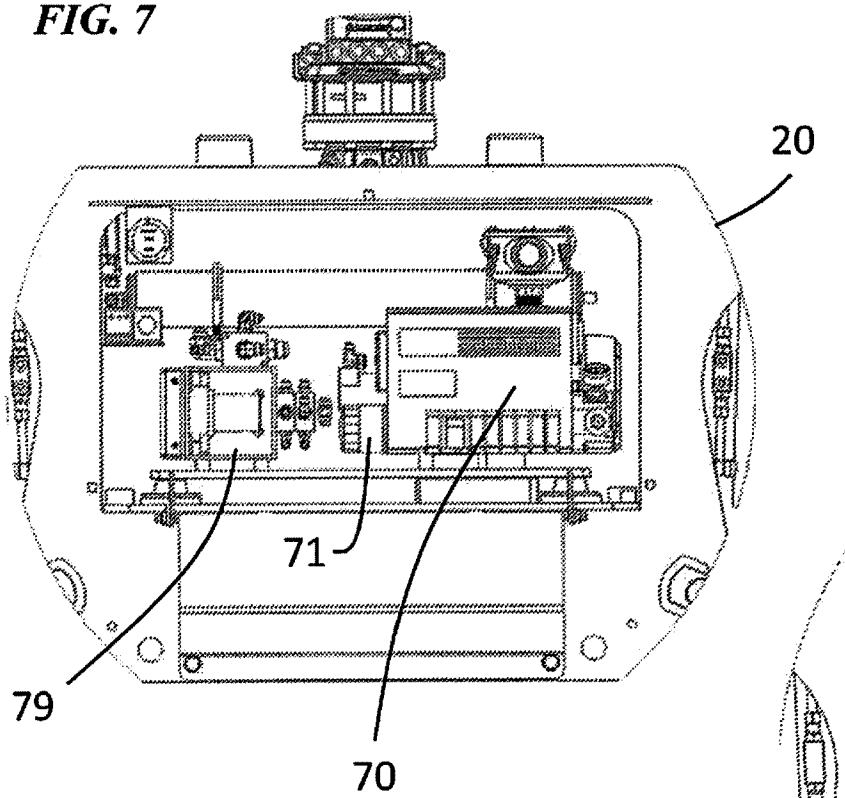
FIG. 7 is an enlarged front elevation view of an embodiment of a material lifter of this disclosure including a frame containing the vacuum pump and hydraulic motors.
Figure 10:
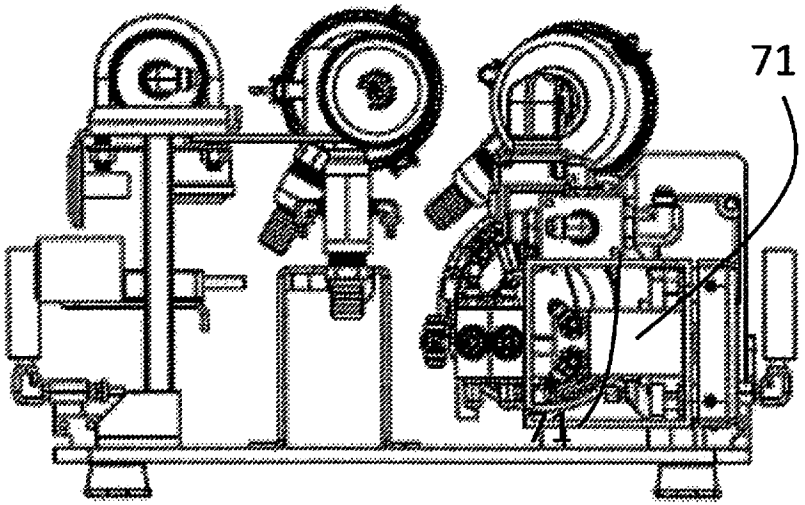
FIG. 10 is a rear isometric view of the baseplate assembly of FIG. 9.
Figure 9:
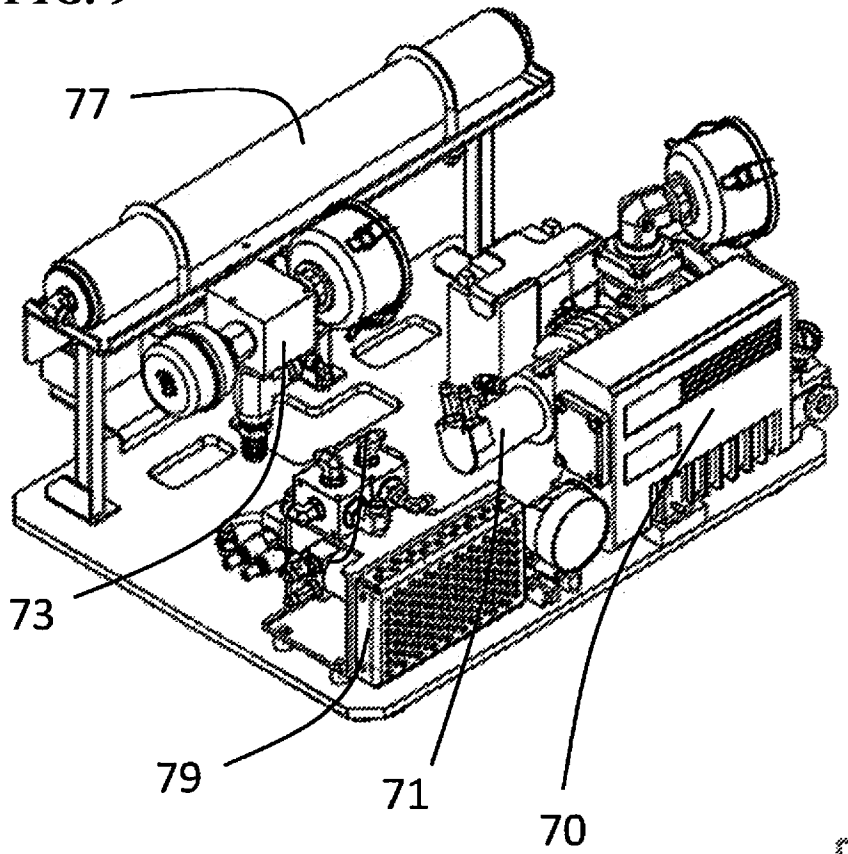
FIG. 9 is an isometric view of an embodiment of a baseplate assembly of this disclosure including the vacuum pump and hydraulic motors.
Figure 12:
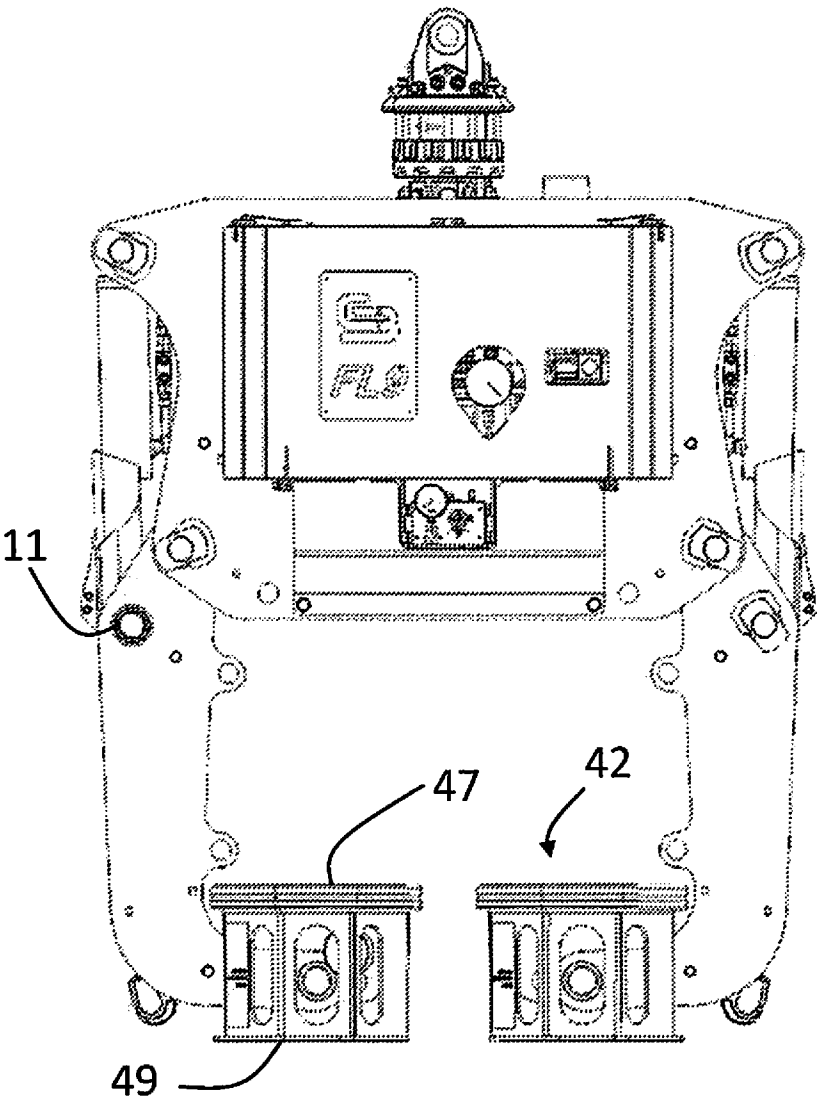
FIG. 12 is a front elevation view of the lifter of FIG. 11 in a stowed position. The top cap or foot of the vacuum pad is directed downward. The vacuum pad seal faces upward.
Figure 11:
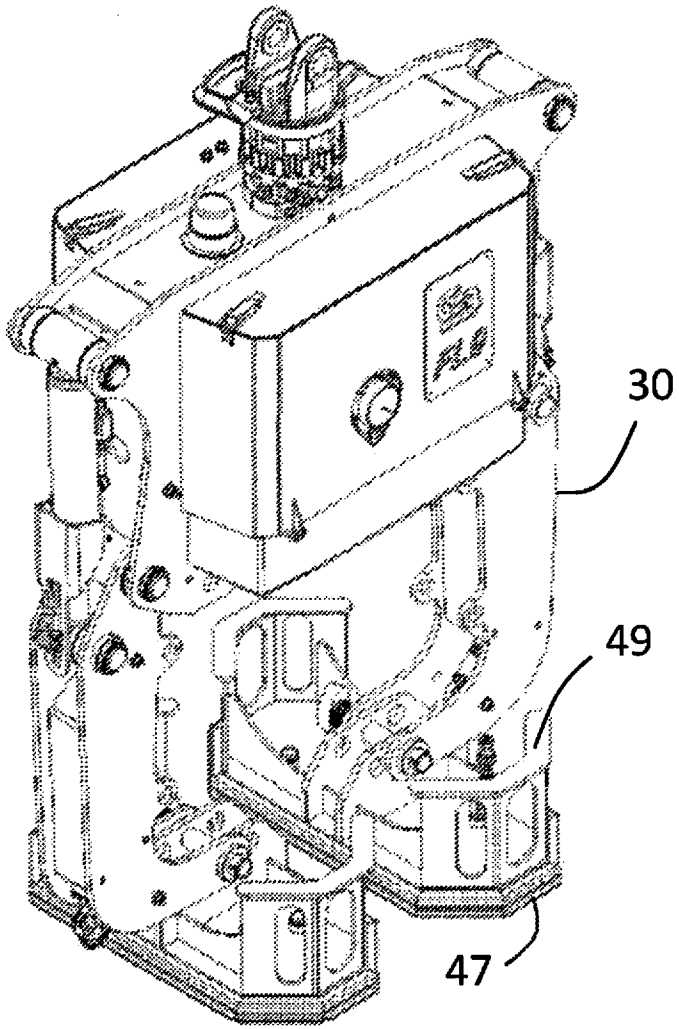
FIG. 11 is an isometric view of an embodiment of a lifter of this disclosure in a fully closed position with the vacuum pad seal directed downward.
Figure 13:
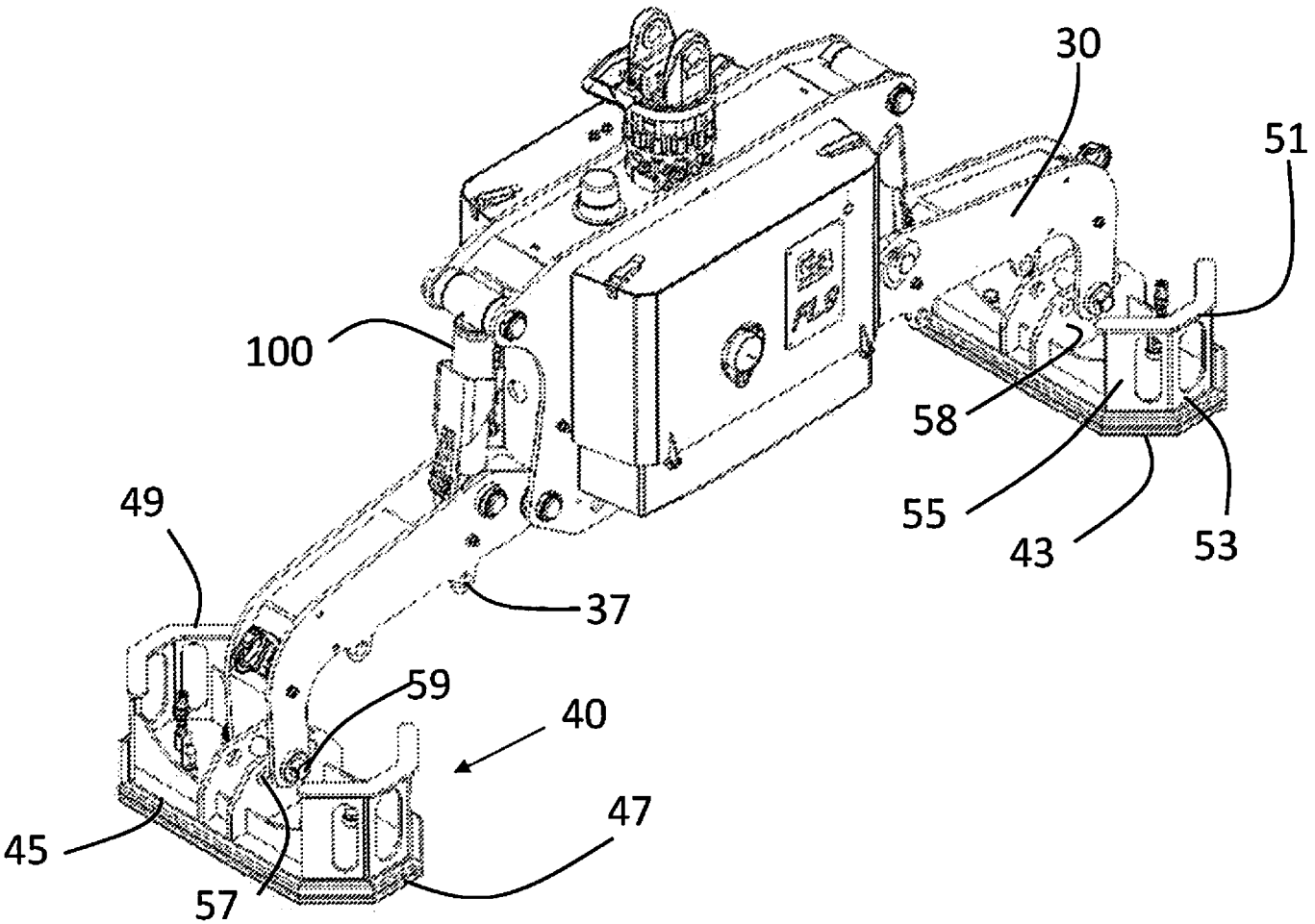
FIG. 13 is an isometric view of the lifter of FIG. 11 in a fully open position.
Figure 15:
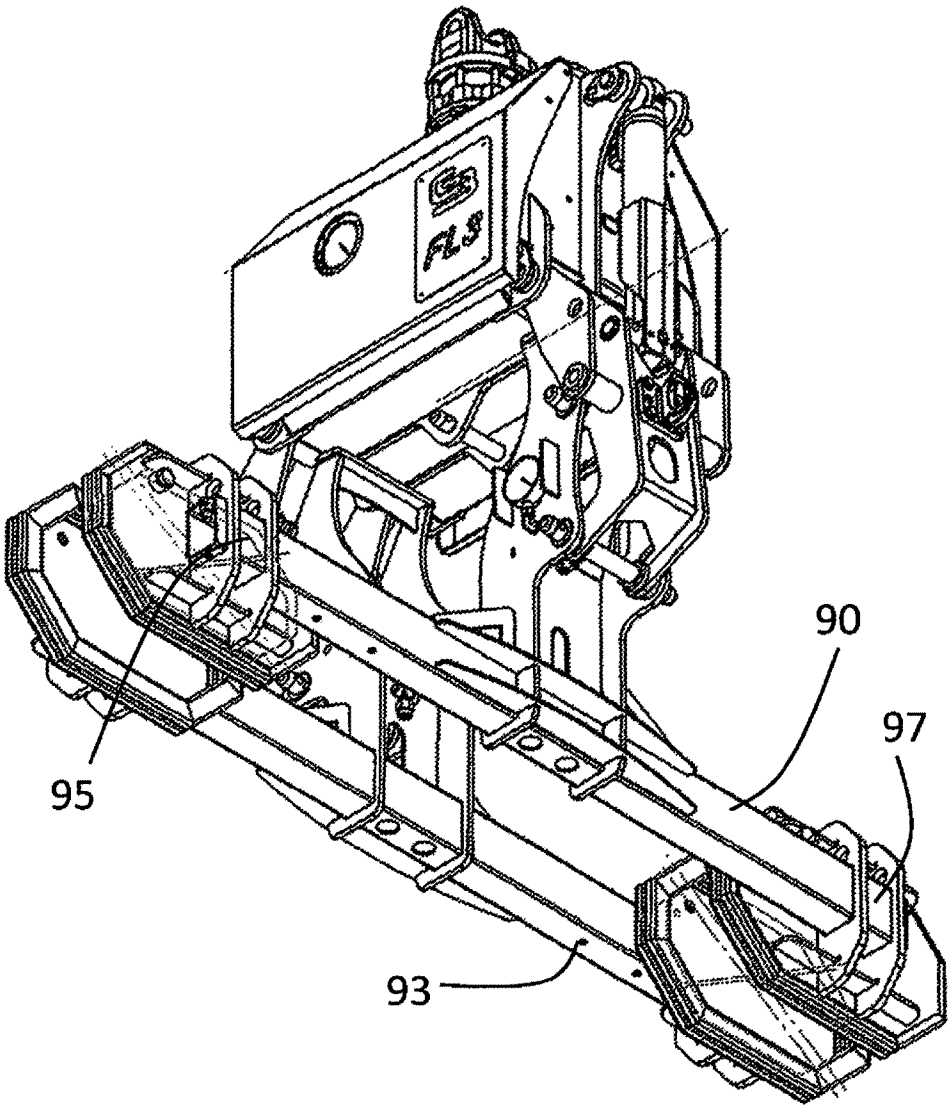
FIG. 15 is a bottom isometric view of the lifter of FIG. 14.
Figure 14:
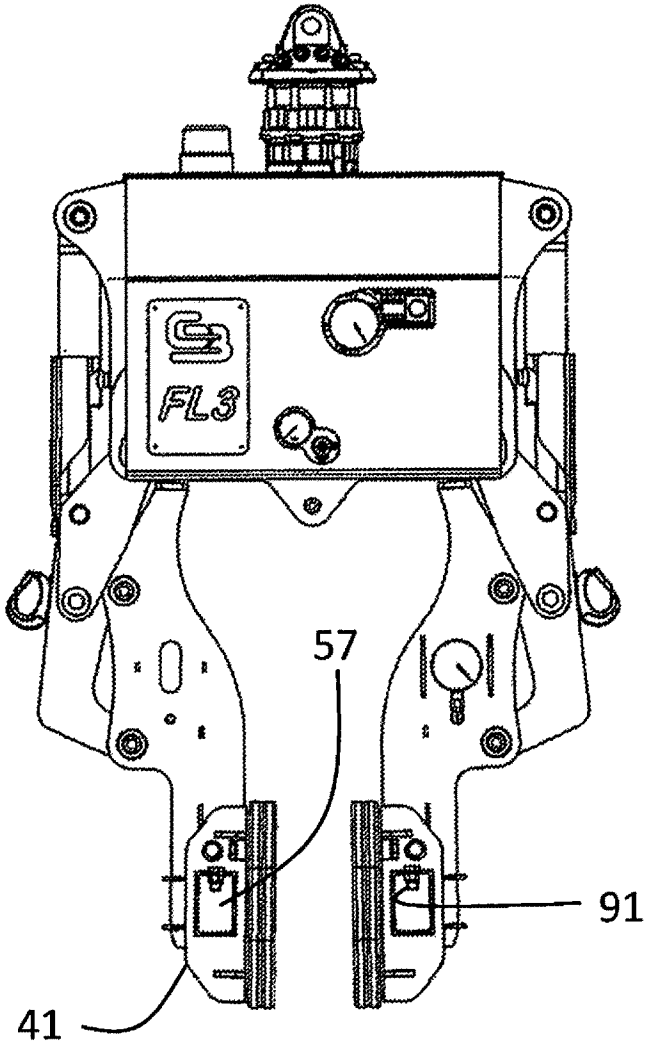
FIG. 14 is a front elevation view of another embodiment of a lifter of this disclosure. The lifter includes a spreader bar connected to each arm.
Figure 17:
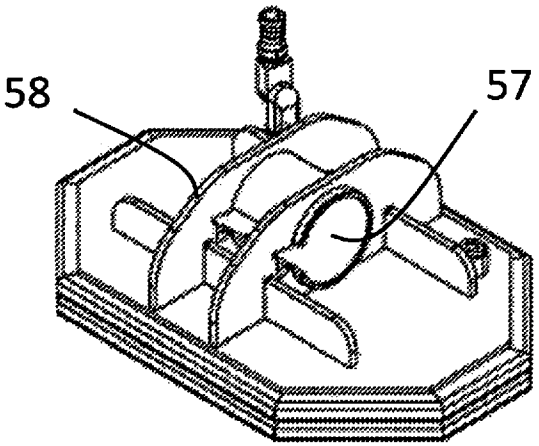
FIG. 17 is an isometric view of an embodiment of a vacuum pad of this disclosure. The vacuum pad may include a pad plate having an opening with a keyway.
Figure 18:
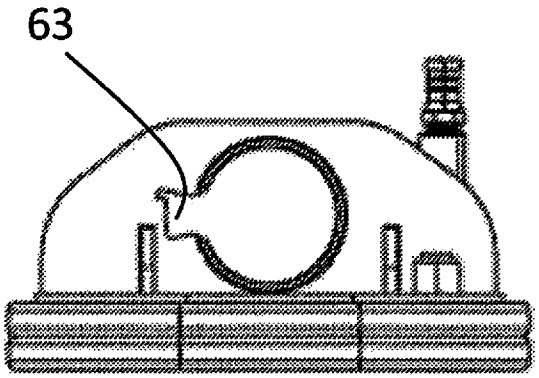
FIG. 18 is a side elevation view of the vacuum pad of FIG. 17.
Figure 16:
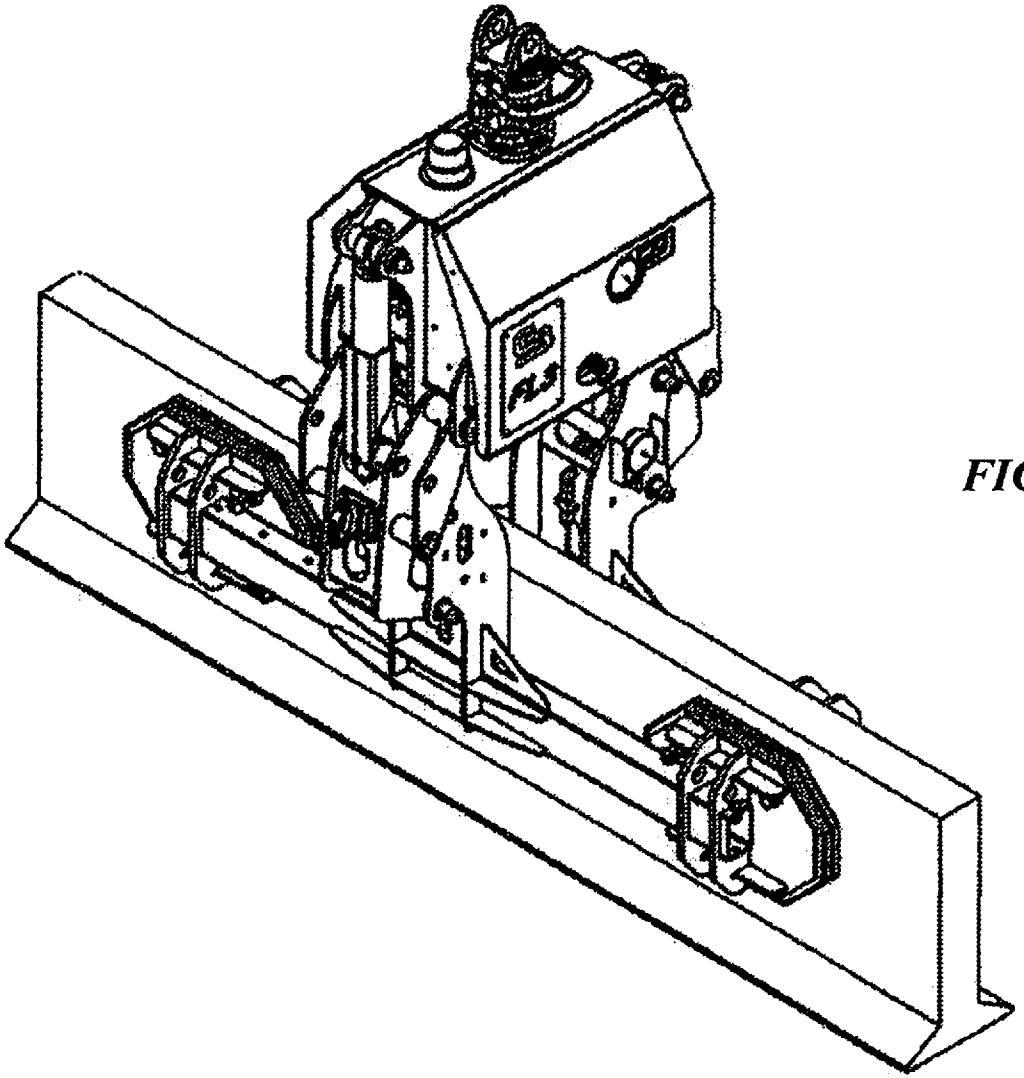
FIG. 16 is an isometric view of the lifter of FIG. 14 when lifting a traffic barrier.
Figure 19:
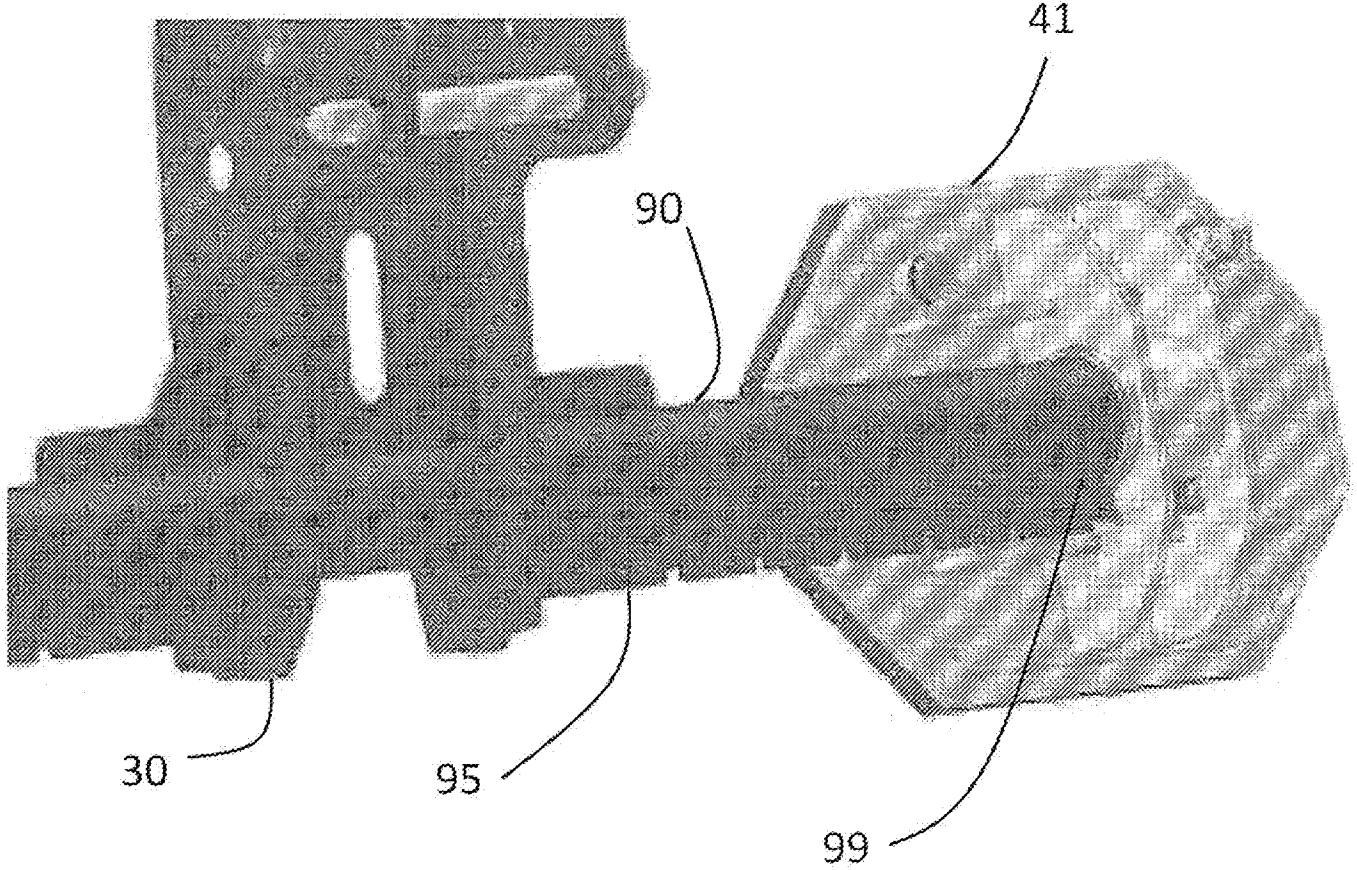
FIG. 19 is a partial isometric view of an embodiment of a spreader bar of this disclosure. The bar may include keys along its length.
Figure 20:
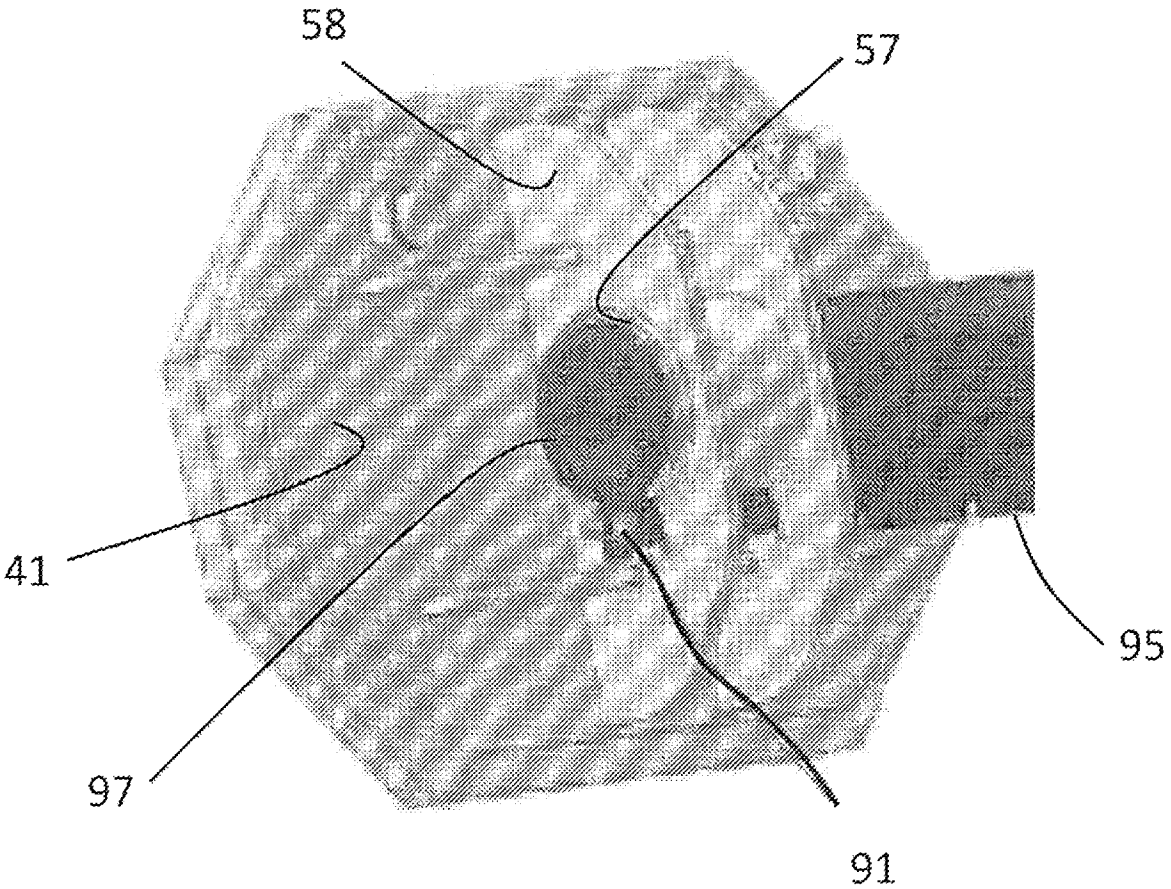
FIG. 20 is a partial isometric view of the other end of the spreader bar of FIG. 19.

Embodiments of this disclosure include a grab-type material lifter 10 having a frame 20, a pair of side arms or legs 30 pivotally connected at an upper end 31 to the frame 20, and a vacuum lifter pad 40 pivotally connected to each arm 30. An actuator 100 may be pivotally connected to an upper end 21 of the frame and to the end 31 of the arm 30. When in a load or unload position, the vacuum lifter pads 40 may be deactivated. When in a lift or carry position, the vacuum lifter pads 40 may be activated. In some embodiments, the pads 40 may be removed and the lifter 10 used with non-vacuum assisted means such as cables and hooks and other types of rigging known in the art.

For the purposes of this disclosure, a grab-type material lifter is a lifter including at least two arms located on opposite sides of the lifter, each arm having one end pivotally connected to the frame, the arms being moveable toward and away from one another. Unique to a grab-type material lifter 10 of this disclosure, the pads 40 may be positioned at different locations along the arms 30 and in different planar orientations. In some embodiments, the pads 40 may be positioned in a horizontal orientation toward a lower end 39 of the arm 30 and then re-positioned in a vertical orientation at the lower end 39 of the arm 30. Other positions along the arm 30 may be used.

In embodiments of this disclosure, the lifter 10 may lift objects when the arms 30 are in a first position and when the arms 30 are in a second different position. The first (second) position may be a fully closed position, the arms 30 being in a vertical orientation, the second (first) position may be a fully open position, the arms 30 being in a horizontal orientation. Or, the arms 30 may be in an intermediate position between fully open and fully closed.

The lifter 10 may also lift objects when the vacuum pads 40 are in a first planar orientation and when the pads 40 are in a second different planar orientation. The first planar orientation may be horizontal (vertical). The second different planar orientation may be vertical (horizontal). As the arms 30 pivot toward and away from one another between a fully open and a fully closed position, the vacuum pads 40 may remain in a predetermined same orientation between, and when in, the fully open and fully closed positions.

The lifter 10 may also lift objects when the vacuum pads 40 are in a first location along the arm 30 and when the pads 40 are in a second different location along the arm 30. The first and second different locations may be predefined locations along the arm 30. One location may be nearer the lower end 39 (or upper end 31) of the arm 30 than the other location.

Where the arm 30 includes pairs of pads 40, the lifter 10 may also lift objects when the vacuum pads 40 are in a first horizontal (or vertical) spacing relative to one another and when in a second different horizontal (or vertical) spacing relative to one another.

The arms 30 may be located on each of two opposing sides 23L, 23R of the frame 20, each arm 30 including an upper end 31 and a lower end 39, the upper end 31 being pivotally connected to the frame 20. In some embodiments, the arm 30 may include a multi-bar linkage, such as a 4-bar linkage, for mechanical advantage. A actuator 100 may be located on each of the two opposing sides 23L, 23R of the frame 20, each actuator 100 including an upper end 101 connected to the frame 20 and a lower end 109 connected to a respective arm 30. The actuator 100 may be a hydraulic cylinder. As the actuators 100 extend and retract, the side arms 30 pivot toward and away from one another between a fully open and a fully closed position and the vacuum pads 40 remain in the predetermined same orientation between, and when in, the fully open and fully closed positions.

A vacuum pad 40 may be located on each of the two opposing sides 23L, 23R of the frame 20, each vacuum pad 40 being in fluid communication with the vacuum pump 70. The vacuum pump 70 may be a hydraulically-driven vacuum pump. The frame 20 may house or contain the vacuum pump 70 and system, including appropriate lines and couplings, hydraulic motors 71, valve 73, and accumulator 77. The frame may also contain an alternator assembly 79.

In embodiments, the vacuum pad 40 may include a vacuum pad blank 41 at its lower end 45 and a top cap or foot 49 at its upper end 51. The pad blank 41 contain a circumferential seal channel or gland 43 sized to receive a pad seal 47. The front and back ends 53 of the pad 40 may include an end cap 55. Ribs 54 may extend along the left and right sides 56. An opening 57 may be used to pivot or orient the pad 40 in a predetermined planar orientation relative to the arm 30. In some embodiments, a complementary shaped pin 59 may inserted into the opening 57 to fix the pad 40 to the arm 30. In some embodiments, a plurality of openings 57 may be included along a spine 58 of the pad 40. One opening 57 of the plurality may be used to orient the pad 40 in a horizontal orientation and another opening 57 of the plurality may be used to orient the pad 40 in a vertical orientation. The openings 57 may be spaced such that the pad 40 is biased to one side or the other to maintain a vertical orientation.

When in an intended use, the pad 40 is oriented so the pad seal 47 may be in a horizontal or a vertical orientation, facing an opposing surface of the object to be lifted. The top cap or foot 49 is then facing away. When being stowed or transported, the pad 40 may be oriented so the top cap or foot 49 is facing downward and the gland 43 or pad seal 47 is facing upward. The lifter 10 may then rest on the feet 49. The pad seal 47 may be any suitable vacuum pad seal for the intended application. By way of a non-limiting example, seal 47 may be a TOUGH SEAL™ vacuum pad seal (Vacuworx, Tulsa, Okla.).

The side arms 30 may be configured to include a spreader bar 90. The spreader bar 90 may be a longitudinally extending bar and may be square-shaped, rectangular-shaped, tube-shaped, oval-shaped, or round-shaped (in cross-section). The pad 40 may be removably connected to the spreader bar 90 and positioned to a predetermined location along its length. To facilitate this positioning, the pad 40 may including an opening 57 shaped complementary to the spreader bar 90. The pad 40 may be slidable along the bar 90. When in a desired location, the pad 40 may be fixed to the bar 90 using pins 91 inserted into corresponding holes 93 or using keys 95. In some embodiments, the pad 40 may be clamped when in its desired location. Where keys 95 are used, opening 57 of the pad 40 may include a complementary keyway 63. The keyway 63 may be shaped so that key 95 is received and then the bar 90 rotated such that the key 95 cannot escape the keyway 63.

Where the bar 90 is not round in cross-section, the bar 90 may be removed from the arm 30, manually rotated so the pad 40 is in a desired orientation, and then reconnected to the arm 30. The pad 40 may also be repositioned along the length of the bar 90 at that time. Where the bar 90 is round in cross-section, it may be rotated without necessarily removing it from the arm 30 and then locked into place. In embodiments, the bar 90 may remain connected to the arm 30, with the pad 40 removed from an end 97, 99 of the bar. The pad 40 may then be rotated relative to the bar 90.

Regardless of the means used to connect the pad 40 to the bar 90, the pads 40 may be in a first location, spacing, and orientation along the bar 90 for a first lifting application and, after the first lifting application is performed, the pads 40 may be moved to a second different location, spacing, and orientation along the bar 90. Other permutations may apply. For example, the location and spacing may change but not the orientation or the orientation may change but not the location and spacing. By way of a non-limiting example, the first lifting application may be a traffic barrier lifting application in which the pad orientation is vertical and the second lifting application may be a concrete slab lifting application in which the pad spacing may be closer and the orientation may be horizontal.

The lifter may be configured to lift loads suitable for vacuum lifting in a range of 0.1 metric tons to 0.8 metric tons (about 220 lbs to about 1,700 lbs) on up to 1 metric ton (about 2,200 lbs), 2 metric tons (about 4,400 lbs), 3 metric tons (about 6,600 lbs), 4 metric tons (about 8,800 lbs), 5 metric tons, (about 11,000 pounds), 6 metric tons (about 13,200 lbs), 7 metric tons (about 15,400 lbs), 8 metric tons (about 17,600 lbs), 9 metric tons (about 19,800 lbs), 10 metric tons (about 22,000 lbs), 11 metric tons (about 24,250 lbs), and 12 metric tons (about 26,500 lbs), there being discrete values and subranges within the broader range of 0.1 metric tons to 12 metric tons.

In some embodiments, the lifter 10 includes two vacuum lifter pads 40, each pad 40 connected to a respective arm 30. In other embodiments, the lifter 10 includes four vacuum pads 40, each pair of pads 40 connected to a respective arm 30 and arranged opposite the opposing pair of pads 40. The two-pad and four-pad embodiments may be used for lifting where the pads 40 are in a horizontal orientation or in a vertical orientation. All things being equal (e.g. pad size, pressure, frame, coupler, etc.), the four-pad embodiment typically has a greater lifting capacity than the two-pad embodiment. The same side arms 30 may be used for the two-pad and the four-pad embodiment, the side arms 30 including a lower end 39 configured to interchangeably receive a pad 40 and the spreader bar 90. Other even multiples of pads 40 may be used.

The lifter 10 may include a coupler 80 located at an upper end 21 of the frame 20 and configured for connection to a boom or host piece of equipment. In some embodiments, the coupler 80 may include a pin-type connector 81 and be configured for rotation about its central vertical axis. The coupler 80 may include appropriate connections and ports for use with a hydraulic fluid supply. The hydraulic fluid supply may be an external hydraulic fluid supply such as that of a piece of construction equipment to which the coupler 80 is connected.

The arms 30 and their respective vacuum lifter pads 40 may pivot independent of one another between a vertical and a horizontal orientation. The pivotal connection 25 between the arms 30 and frame 20, as well as pivotal connection 35 between the arms 30 and pads 40, may include a pin and bushing arrangement 11. In embodiments, the pins and bushings may be a hardened alloy steel. The pads 40 may be self-leveling in the horizontal position or in the vertical position. The arms 30 may be a high tensile steel. In some embodiments, the arms 30 may be L-shaped arms.

The vacuum lifter pads 40 may be any size and shape suitable for the object to be lifted. For example, the pad 40 may be shaped complementary to the object. In some embodiments, the pad 40 may include a flat or planar lift surface 42. In other embodiments, the pad may include a concave curved or rounded lift surface 42. The pads 40 may be interchangeable so that the lifter 10 may be used in a first lifting application and then in a second different lifting application. Each lifting application may be directed toward objects of different shape, weight, or shape and weight, and may require the pads 40 to be placed in a first orientation for one application and a second different orientation for another application. The vacuum pad seal 47 used may be a TOUGH SEAL™ vacuum pad seal (Vacuworx, Tulsa, Okla.).

A vacuum pump 70 connected to the vacuum lifter pads 40 may be driven by a self-contained engine or hydraulically powered by the host piece of equipment. In some embodiments, the pump 70 may be electrically powered. The pads 40 and pump 70 may be configured to lift objects in a range of 0.1 metric tons to 0.8 metric tons (about 220 lbs to about 1,700 lbs) on up to 2 metric tons (about 4,400 lbs), or on up to 5 metric tons (about 11,000 lbs), there being subranges within these broader ranges. By way of a non-limiting example, operating pressure may be about 200 bar (2900 psi). The vacuum pad seal 43 may be a TOUGH SEAL™ vacuum pad (Vacuworx, Tulsa, Okla.).

The side arms 30 may be hydraulically actuated. In some embodiments, hydraulic fluid or oil of the host piece of equipment may be used, with the hydraulic cylinders 100 including a no-return valve. Or, the source of the hydraulic fluid may be self-contained. By way of a non-limiting example, oil flow may be about 60 L/min (16 gallons/min). An oil flow divider valve or its equivalent may be used to hydraulically synchronize the arms 30. In other embodiments, the arms 30 may be pneumatically actuated or electrically actuated.

Each side arm 30 may include eyes or lift pads 37 located along its length. The pad 40 may be moved to different eyes 37 to accomplish different spacings, each eye 37 defining a different location along the arm. For example, a first eye 37 may define a first location along the arm 30 and the second eye may define a second location along the arm 30.

The frame 20 may include an onboard drive engine configured to power an actuator or cylinder 100 connected to each side arm 40 and a vacuum pump 70 in communication with the vacuum pads 40. In some embodiments, the frame 20 may include an onboard hydraulic fluid pump in communication with the side arms 40, an onboard vacuum pump 70 in communication with the vacuum lifter pads 40, and an onboard drive engine configured to drive the pumps. The drive engine may be an internal combustion engine. In other embodiments, the drive engine may be an electric-powered motor. In other embodiments, the drive engine may be an hydraulic powered motor.

The embodiments described above provide examples of a material lifter of this disclosure and are the best known to the inventors at the time of this application's filing. The examples do not cover all possible embodiments. The following claims, therefore, are not limited by the examples and each recited element is entitled to its full range of equivalents.

The invention claimed is:

1. A method for providing grab-type lifting with a vacuum material lifter (10), the method comprising:

providing the vacuum material lifter including:

a frame (20) containing a vacuum pump (70);

an arm (30) located on each of two opposing sides (21) of the frame, each arm including an upper (31) and a lower end (39), the upper end pivotally connected to the frame;

the method further comprising:

in a first lifting application, pivotally connecting a vacuum pad to each of the arms at first predetermined location along each arm, the vacuum pads being in a first orientation after the pivotally connecting;

in a second lifting application different than the first lifting application, fixedly connecting the vacuum pad to each of the arms at a second predetermined location along each arm, the vacuum pads being in a second orientation different than that of the first orientation; and wherein in the first and second lifting applications, the method further comprises:

pivoting the arms toward and away from one another between a first position and a second position different from the first position to place the vacuum pads in contact with an object in first location; and after the contact, applying a vacuum to the vacuum pads and lifting the object;

after the lifting, placing the object in a second location after the placing, removing the vacuum to the vacuum pads and releasing the object.

2. The method of claim 1, wherein, the vacuum material lifter includes a cylinder (100) located on each of the two opposing sides of the frame, each cylinder including an upper end (101) connected to the frame and a lower end (109) connected to a respective arm, wherein, the method further comprises extending and retracting the cylinders, and as the cylinders extend and retract:

the arms pivot toward and away from one another between a first position and a second different position; and the vacuum pads remain in a same orientation during the pivot.

3. The method of claim 1, wherein, the first orientation and second orientation differ from one another by 90°.

4. The method of claim 1, wherein the first predetermined location is nearer one end (31, 39) of the arm than is the second predetermined location.

5. The method of claim 1, wherein, the vacuum material lifter further comprises:

each arm includes a spreader bar (90), the vacuum pad removably connected to the spreader bar.

6. The method of claim 5, wherein, the vacuum material lifter further comprises:

each vacuum pad includes an opening (57) shaped complementary to a cross-section of the spreader bar and sized to receive the spreader bar.

7. The method of claim 6, wherein, the spreader bar includes a plurality of keys (95) and the opening of the each vacuum pad includes a keyway (63) sized to receive a key of the plurality of keys.

8. The method of claim 1, wherein, each vacuum pad includes a gland (43) at a lower end (45) and a top cap (49) at an upper end (51).

9. The method of claim 1, wherein, each arm includes at least two eyes (37) spaced apart from one another, one eye defining the first predetermined location, the second eye defining the second predetermined location;

the vacuum pad including a pad blank (41) having an opening (57) sized complementary to that of the at least two eyes; and a pin (59) sized to be received by the opening and each of the eyes;

wherein the pin connects the pad blank to the arm.

10. A method for providing grab-type lifting with a vacuum material lifter (10), the vacuum material lifter including a frame (20) containing a vacuum pump (70) and an arm (30) located on each of two opposing sides (21) of the frame, each arm including an upper (31) and a lower end (39), the upper end pivotally connected to the frame; the method comprising:

in a first lifting application, pivotally connecting a vacuum pad to each of the arms at first predetermined location along each arm, the vacuum pads being in a first orientation after the pivotally connecting;

in a second lifting application different than the first lifting application, fixedly connecting the vacuum pad to each of the arms at a second predetermined location along each arm, the vacuum pads being in a second orientation different than that of the first orientation; and wherein in the first and second lifting applications, the method further comprises:

pivoting the arms toward and away from one another between a first position and a second position different from the first position to place the vacuum pads in contact with an object in first location; and after the contact, applying a vacuum to the vacuum pads and lifting the object;

after the lifting, placing the object in a second location after the placing, removing the vacuum to the vacuum pads and releasing the object.

11. The method of claim 10, wherein, the vacuum material lifter includes a cylinder (100) located on each of the two opposing sides of the frame, each cylinder including an upper end (101) connected to the frame and a lower end (109) connected to a respective arm, wherein, the method further comprises extending and retracting the cylinders, and as the cylinders extend and retract:

the arms pivot toward and away from one another between a first position and a second different position; and the vacuum pads remain in a same orientation during the pivot.

12. The method of claim 10, wherein, the first orientation and second orientation differ from one another by 90°.

13. The method of claim 10, wherein the first predetermined location is nearer one end (31, 39) of the arm than is the second predetermined location.

14. The method of claim 13, wherein, the vacuum material lifter further comprises:

each arm includes a spreader bar (90), the vacuum pad removably connected to the spreader bar.

15. The method of claim 14, wherein, the vacuum material lifter further comprises:

each vacuum pad includes an opening (57) shaped complementary to a cross-section of the spreader bar and sized to receive the spreader bar.

16. The method of claim 15, wherein, the spreader bar includes a plurality of keys (95) and the opening of the each vacuum pad includes a keyway (63) sized to receive a key of the plurality of keys.

17. The method of claim 10, wherein, each vacuum pad includes a gland (43) at a lower end (45) and a top cap (49) at an upper end (51).

18. The method of claim 10, wherein, each arm includes at least two eyes (37) spaced apart from one another, one eye defining the first predetermined location, the second eye defining the second predetermined location;

the vacuum pad including a pad blank (41) having an opening (57) sized complementary to that of the at least two eyes; and a pin (59) sized to be received by the opening and each of the eyes;

wherein the pin connects the pad blank to the arm.

19. The method of claim 10, further comprising, providing the vacuum material lifter.

* * * * *